US011691781B2

(12) United States Patent
Kulkarni et al.

(10) Patent No.: US 11,691,781 B2
(45) Date of Patent: Jul. 4, 2023

(54) HINGED-LID PACKAGING

(71) Applicant: JT International S.A., Geneva (CH)

(72) Inventors: Pranav Kulkarni, Trier (DE); Oleksandr Zhurba, Trier (DE)

(73) Assignee: JT International S.A.

( * ) Notice: Subject to any disclaimer, the term of this patent is extended or adjusted under 35 U.S.C. 154(b) by 346 days.

(21) Appl. No.: 16/770,446

(22) PCT Filed: Dec. 7, 2018

(86) PCT No.: PCT/EP2018/083957

§ 371 (c)(1),
(2) Date: Jun. 5, 2020

(87) PCT Pub. No.: WO2019/110792

PCT Pub. Date: Jun. 13, 2019

(65) Prior Publication Data

US 2021/0114799 A1 Apr. 22, 2021

(30) Foreign Application Priority Data

Dec. 8, 2017 (EP) ..... 17206277

(51) Int. Cl.
*B65D 5/66* (2006.01)
*B65D 85/10* (2006.01)

(52) U.S. Cl.
CPC ..... *B65D 5/6614* (2013.01); *B65D 85/1056* (2020.05); *B65D 85/10566* (2020.05); *B65D 85/10568* (2020.05)

(58) Field of Classification Search
CPC ..... B65D 85/1056; B65D 5/6614; B65D 85/10566; B65D 85/10568
(Continued)

(56) References Cited

U.S. PATENT DOCUMENTS 2,349,589 A 5/1944 Harrington
4,588,081 A * 5/1986 Newsome ..... B65D 85/1036 229/122.34
(Continued)

FOREIGN PATENT DOCUMENTS

EP 2786941 A1 10/2014
JP H03102487 U 10/1991
(Continued)

OTHER PUBLICATIONS

Extended European Search Report including the Written Opinion for Application No. EP 17206277.0 dated May 4, 2018, 7 pages.
(Continued)

*Primary Examiner* — Rafael A Ortiz
(74) *Attorney, Agent, or Firm* — Lerner David LLP

(57) ABSTRACT

A container for consumer goods includes a box for receiving goods, the box having an open end; a lid rotatable between open and closed positions for respectively opening and closing the open end of the box; a hinged connector that connects the lid to the box, where the hinged connector is connected to the lid at a connector-lid hinge line and connected to the box at a connector-box hinge line; and, a resilient mechanism arranged between the box and the connector such that, during lid opening, the resilient mechanism causes relative movement of the box to the connector.

14 Claims, 10 Drawing Sheets

(58) Field of Classification Search
USPC ..... 206/242, 250, 252, 254, 264–268, 271, 206/273, 127, 120, 246, 258, 256
See application file for complete search history.

(56) References Cited

U.S. PATENT DOCUMENTS

| | | | | |
|---|---|---|---|---|
| 5,174,492 | A * | 12/1992 | Gero | B65D 5/5213 229/128 |
| 7,681,727 | B2 * | 3/2010 | Hunt | B65D 85/1036 206/268 |
| 2005/0199517 | A1 | 9/2005 | Petrucci et al. | |
| 2008/0223912 | A1 | 9/2008 | Ayats Ardite et al. | |
| 2014/0124395 | A1 * | 5/2014 | Nadeau | B65D 5/5213 206/250 |
| 2016/0332802 | A1 * | 11/2016 | D'Alfonso | B65D 85/1036 |
| 2020/0079579 | A1 * | 3/2020 | Marchitto | B65D 85/1056 |

FOREIGN PATENT DOCUMENTS

| | | | |
|---|---|---|---|
| JP | 2005287508 | A | 10/2005 |
| JP | 2008504181 | A | 2/2008 |
| JP | 2010036941 | A | 2/2010 |
| JP | 2015503494 | A | 2/2015 |
| WO | 2013102841 | A1 | 7/2013 |
| WO | 2015186089 | A1 | 12/2015 |
| WO | 2017021811 | A1 | 2/2017 |
| WO | WO-2017021811 | A1 * | 2/2017 |
| WO | 2017089559 | A1 | 6/2017 |

OTHER PUBLICATIONS

International Search Report including the Written Opinion from Application No. PCT/EP2018/083957 dated Feb. 20, 2019, 13 pages.

* cited by examiner

HINGED-LID PACKAGING

CROSS-REFERENCE TO RELATED APPLICATIONS

The present application is a national phase entry under 35 U.S.C. § 371 of International Application No. PCT/EP2018/083957, filed Dec. 7, 2018, published in English, which claims priority to European Application No. 17206277.0 filed Dec. 8, 2017, the disclosures of which are incorporated herein by reference.

BACKGROUND OF THE INVENTION

The present invention relates to a container for consumer goods, in particular a container for smoking articles, the container having a hinged-lid.

It is common for cigarette containers to have a hinged-lid. Hinged-lid packaging typically includes a box and an upper lid that is coupled to the box by means of a hinge and moveable between an open position in which the goods in the box are accessible and a closed position in which the lid covers an open end of the box. It has long been a problem with such packaging that the user must grip the lid once opened to enable retrieval of the goods from the open end of the box. This problem is exacerbated by the resilient nature of the hinge. A hinge which is durable and sturdy inherently has an increased biasing force. Such hinged-lids also do not provide a satisfactory feel for the user. It can be difficult for a user to know whether the lid is fully open or closed.

Since this has been a problem in the industry for some time there has, of course, been attempts to address these deficiencies. EP2786941 describes one such container. In this container, a spring member or flap is attached to the interior of the box and attached to an inner surface of the lid. The member includes a bent line parallel to the hinge. The panels of the member provide a spring effect which pushes the lid away from the open end of the box.

Such containers suffer problems when in use. For example, the spring member reduces the space available for goods within the box. Moreover, as the panels of the member move away from the rear wall of the box as the lid is opened, the items within the box may be squeezed, leading to deformation of soft articles, such as cigarettes, or other undesirable damage.

These containers have also proved difficult to manufacture as the panels are separate elements and require adhering to the inner surface of the box and lid. It has been shown that glue is often not strong enough or effective enough to provide necessary adhesion and the addition of the member is problematic on the production line.

It has also been identified that the inner panels ruin the look and feel of the box in the eyes of the user. This is also a problem suffered by an obvious modification to the design of the container, that is, to move the spring member to the outside of the box. In this configuration, an external spring member would bias the lid away from the open end of the box. This external member, or flap, can appear ugly and is detrimental to the external look and feel of the packaging. Perhaps more importantly though such external spring members tend to jam the manufacturing machines.

BRIEF SUMMARY OF THE INVENTION

The present invention addresses the long-established problem of enabling access to products in hinged-lid packaging without the user needing to grip the hinged-lid.

According to an aspect of the present invention there is provided a container for consumer goods. The container comprises: a box for receiving goods, the box comprising an open end; a lid rotatable between open and closed positions for respectively opening and closing the open end of the box; a hinged connector that connects the lid to the box, where the hinged connector is connected to the lid at a connector-lid hinge line and connected to the box at a connector-box hinge line; and, a resilient mechanism arranged between the box and the connector such that, during lid opening, the resilient mechanism causes relative movement of the box to the connector.

The resilient mechanism and connector together move the lid away from the open end of the box such that the articles stored within the box can be easily retrieved, remain unaffected within the box, and the storage capability of the box is unaffected as compared to conventional packaging. For example, a consumer may only need one hand to open the lid and keep the lid open where typically two hands may be needed.

Additionally, the hinged connector provides a communication space for a producer to provide promotional messages to the consumer, as appropriate, such as branding or other messages. Simply providing an area where the producer can adjust the look or detail of the container may provide advantageous effects. Importantly, the hinged connector also provides packaging reinforcement to alleviate the need for additional panels to prevent deformation of the container.

Preferably the connector-lid and connector-box hinge lines are substantially parallel to each other. Thus the arrangement provides for the lid to close the open end of the box in use and move the connector portion away from the box when the lid is in an open position.

The resilient mechanism may preferably be articulately mounted to the hinged connector and the box. Accordingly, the resilient mechanism may form a joint with both the hinged connector and the box so as to bias the hinged connector away from the box.

The resilient mechanism may comprise at least one articulated structure. Thus the resilient mechanism is provided simply and easily during manufacture and without the addition of complicated components to bias the connector away from the box.

The articulated structure may comprise at least two panels, a first panel rotatably mounted to the hinged connector along a panel-connector rotation axis, and a second panel rotatably mounted to the box along a panel-box rotation axis.

The panel-connector and panel-box rotation axes may be substantially parallel to each other when the lid is in the closed position.

The panel-connector rotation axis may be substantially perpendicular to the connector-lid hinge line.

In certain embodiments, movement of the lid from the closed position towards the open position causes the panel-connector and panel-box rotation axes to rotate relative to each other so as to form an angle with each other in the open position.

Alternatively, the panel-connector and panel-box rotation axes remain substantially parallel to each other during movement of the lid between the open and closed positions.

In this embodiment the panel-connector rotation axis may be substantially coincident with the connector-lid hinge line.

Preferably, the first panel may be hingedly connected to the second panel along a panel-panel hinge line.

More preferably the panel-panel hinge line is substantially parallel to the panel-connector rotation axis and to the panel-box rotation axis during movement of the lid between the open and closed positions.

Alternatively the panel-panel hinge line is at a first angle with respect to the panel-connector rotation axis, wherein the panel-panel hinge line is at a second angle with respect to the panel-box rotation axis, and wherein the first and second angles are substantially the same.

Preferably, two or more of the box, lid, resilient mechanism and hinged connector may be formed integral with each other. Typically, the box, lid, resilient mechanism and hinged connector may all be integral with each other.

According to another aspect of the present invention there is provided a blank for forming a container for consumer goods, comprising a box portion, a lid portion, a connector portion, the connector portion connected to the box portion along a connector-box hinge line and to the lid portion along a connector-lid hinge line, the blank further comprising at least two panels hingedly connected to each other, wherein one of the panels is connected to either the box portion along a panel-box hinge line or to the connector portion along a panel-connector hinge line.

Preferably the connector-lid and connector-box hinge lines are substantially parallel to each other.

The box, lid, resilient mechanism and hinged connector may be made integral by being formed from a single blank.

BRIEF DESCRIPTION OF THE DRAWINGS

Specific embodiments of the present invention will now be described by way of example only, with reference to the accompanying drawings in which.

DETAILED DESCRIPTION

Figure 1:
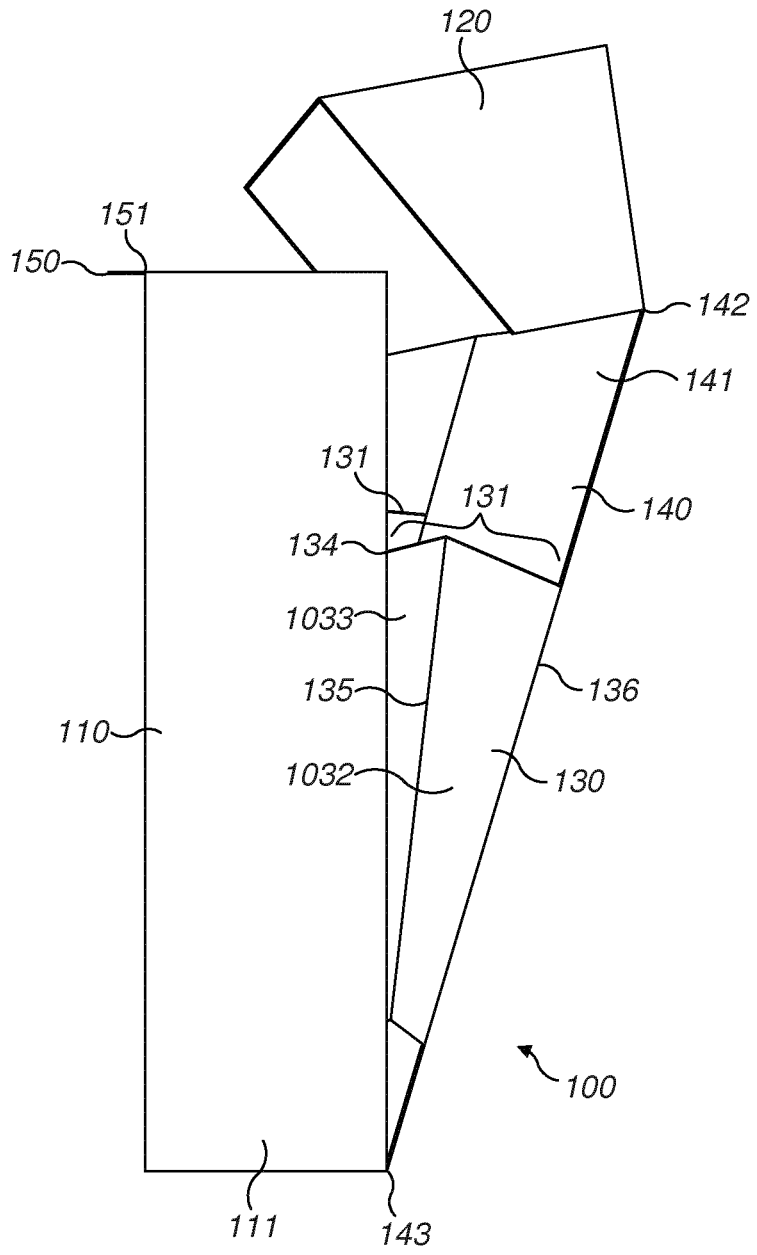
FIG. 1 is a side view of a container for smoking articles in accordance with the present invention.

In each of the figures illustrating blanks, crease lines are illustrated by dashed lines and cut lines illustrated by solid lines. Where items are identical or similar, like reference numerals are used.

Figure 9:
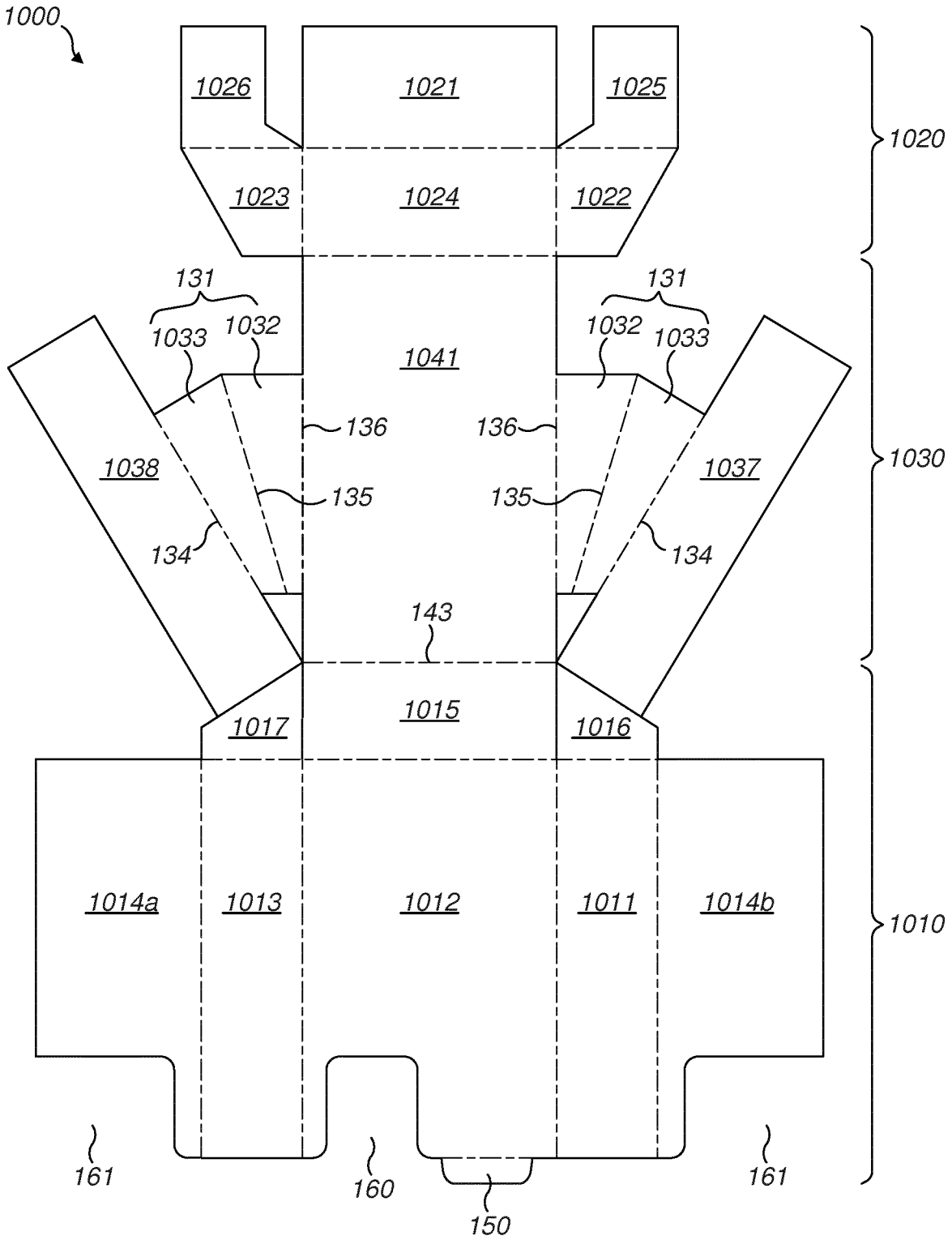
FIG. 9 schematically illustrates a blank which may be used to form the container of FIGS. 1 to 3.
Figure 10:
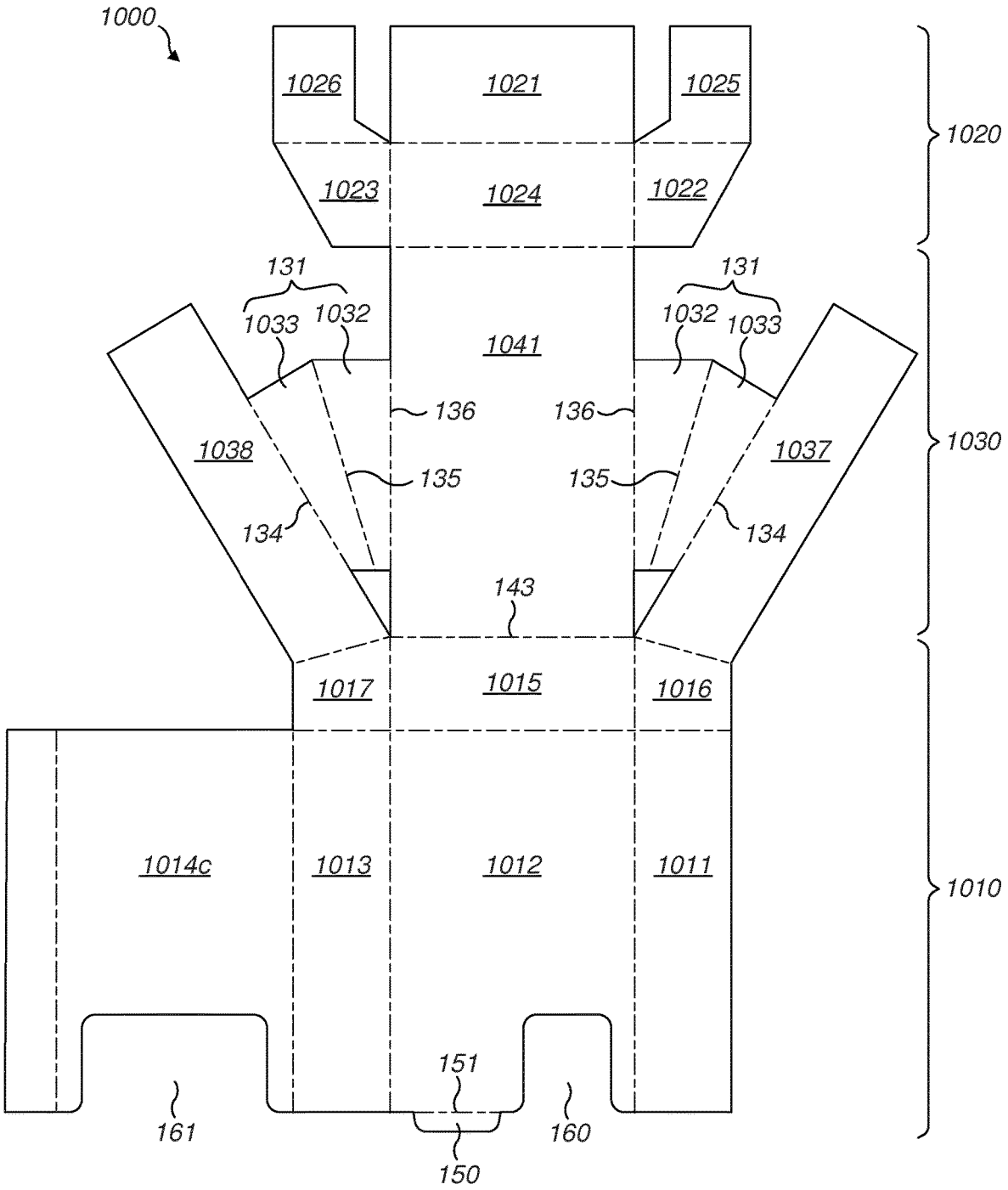
FIG. 10 schematically illustrates an alternative blank which may be used to form the container of FIGS. 1 to 3.
Figure 11:
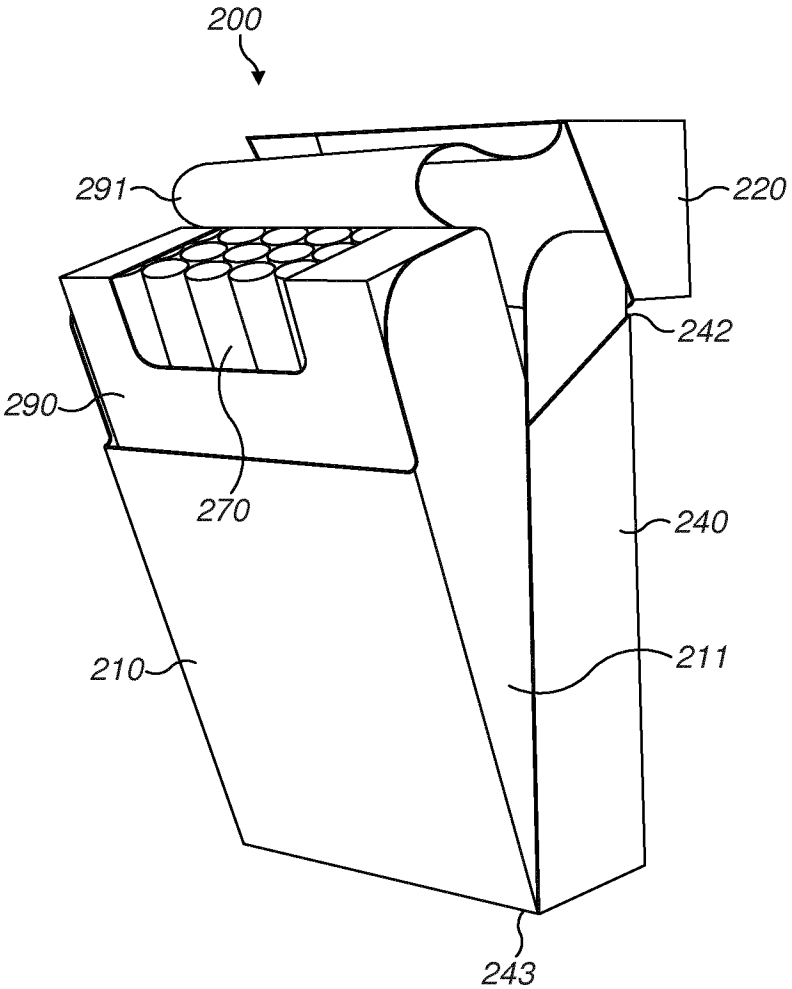
FIG. 11 is a perspective view of an alternative container for smoking articles in accordance with the present invention.

FIGS. 1 to 10 illustrate a first example incorporating the principles of the invention while FIG. 11 onwards illustrate a second example. Although these two example containers differ slightly from each other as will become clear from the following description, each of the containers 100, 200, embox the principle of a box 110, 210 and a hinged lid 120, 220 which is biased away from an open end of the box 110, 210 in an open position using an integral resilient mechanism 130, 230 hidden from the consumer in a closed position. The two examples described provide alternatives to address the outstanding problems in the state of the art using a common design approach. It will be understood that the two examples are not mutually exclusive and that any ideas or concepts described in the context of each example may be utilised in the other example container.

FIG. 1 shows a container 100 for smoking articles in accordance with the present invention. A container 100 is shown having a box 110 which receives the goods in question. To close the top, open end of the box 110 there is provided a lid 120. Since FIG. 1 is a side view of the container, only a side wall 111 of the box 110 is illustrated.

The lid 120 is hingedly connected to the box 110 of the container 100 via a hinged connector 140. The lid 120 comprises a plurality of side walls as well as a top wall. One of the side walls forms the front wall of the lid 120. In the illustrated example of FIG. 1, the hinged connector 140 forms the rear wall of the lid 120, however this is not essential and a further rear wall of the lid 120 may be provided and hinged to the hinged connector 140.

As mentioned, the hinged connector 140 is arranged between the box 110 and the lid 120. In the illustrated example, the hinged connector 140 is integral with both the box 110 and the lid 120. In the example, the hinged connector 140 is formed of a single panel 141 hingedly connected to the base of the box 110 and hingedly connected to the rear of the top wall (not shown) of the lid 120. The lid hinge allows the lid 120 to rotate about the lid hinge 142. The hinge 143 between the box 110 and the hinged connector 140 allows the hinged connector 140 to rotate about the connector-box hinge 143. The two hinges 142, 143 allow for rotational movement of the hinged connector 140 and the lid 120 about the base of the box 110 and the lid 120 to rotate about the top end of the hinged connector 140. The two rotations allow the lid 120 to move between a closed position in which the lid 120 closes the top, open end of the box 110 and an open position in which the lid 120 does not close the top, open end of the box 110.

Illustrated in FIG. 1 is a resilient mechanism 130 arranged between the box 110 and the hinged connector 140. The resilient mechanism 130 causes relative movement of the hinged connector 140 away from the box 110. That is, the resilient mechanism 130 biases the hinged connector 140, and therefore the lid 120, away from the box 110. Thus, when the lid 120 is moved manually by a consumer away from the open position, the resilient mechanism 130 moves the hinged connector 140 in a rotational manner about the connector-box hinge 143 between the base of the box 110 and the hinged connector 140 so as in turn to move the lid 120 away from the open end of the box 110.

In the first example illustrated in FIG. 1, the resilient mechanism 130 is formed of an articulated structure 131 of two panels 1032, 1033; a first panel 1032 is hinged to the hinged connector 140 and to a second panel 1033, with the second panel 1033 also hinged to the box 110. It will be understood of course that the panel structure 131 may include any number of panels 1032, 1033 arranged to move the hinged connector 140 away from the box 110. The container 100 includes two articulated panel structures 131 at each side of the box 110.

The example illustrated includes two panels 1032, 1033. Each of the panels 1032, 1033 are substantially identical to maintain symmetry in the packet design.

In the example of FIG. 1, each panel 1032, 1033 is shaped as an elongated convex scalene quadrilateral. In the first panel 1032 the two shorter sides are substantially perpendicular to the side 136 that is hinged to the hinged connector 140, while in the second panel 1033 only one of the shorter sides is substantially perpendicular to the side 134 that is hinged to the rear wall of the box 110. Therefore, the first panel 1032 has a trapezoid shape, while the second panel 1033 has a right-angled trapezium shape. In the articulated panel structure 131, each panel 1032, 1033 is arranged to have the longer of the two parallel sides toward the top end of the container 100.

When the hinged connector 140 is pushed toward the box 110, the panels 1032, 1033 fold inwardly between the hinged connector 140 and the rear wall of the box 110. The panel structure 131 is arranged so as to bias the hinged connector-140 outwardly. The hinges 134, 135, 136 of the panel structure 131 are configured to be resilient so as to revert to a straight configuration after folding inwardly when not held in place by the closure of the lid.

As illustrated in FIG. 1, the arrangement described above leads to the first panel 1032 being rotatably mounted to the hinged connector 140 along a panel-connector rotation axis 136, and the second panel 1033 being rotatably mounted to the box 110 along a panel-box rotation axis 134. The panel-connector 136 and panel-box 134 rotation axes are substantially parallel to each other when the lid is in the closed position. The panel-connector rotation axis 136 is substantially perpendicular to the connector-lid hinge line 142, that is, where the hinged connector 140 is hinged to the lid 120. Movement of the lid 120 from the closed position towards the open position causes the panel-connector 136 and panel-box 134 rotation axes to rotate relative to each other so as to form an angle with each other in the open position.

Further illustrated in FIG. 1 is an optional locking mechanism 150 formed of a tongue or locking tab 150 for engagement with an inner portion of the lid 120 (not shown). The tongue 150 is formed at the top end of the front wall of the box 110, as shown.

The tongue or locking tab 150 comprises an engaging edge for engaging with an engagement edge when the lid 120 of the container 100 is in the closed position. The tongue 150 is hingedly attached (or connected) to the box 110 via a tongue hinge 151. The base of the tongue or locking tab 150 is adjacent the tab hinge 151 and a tip of the locking tab is distal to the tab hinge 151. The locking tab 150 may be located on the front side of the box 110, for example, on the front wall 112 of the box 110 and preferably extending from the front wall 112 of the box 110 in the open top end thereof or alternatively to an inner side of the front wall of the lid. The tongue hinge 151 allows the locking tab 150 to rotate relative to the box 110 about the hinge 151. Not shown is an engagement edge for engaging with the locking tab 150 when the lid 120 of the container 100 is in the closed position. The engagement edge may be an edge of a recess cut-out into a panel or a tab of the lid portion of the blank. The engagement edge may also be an edge of a panel or a tab of the lid portion of the blank that is shaped and positioned so that the tip of the tongue engages it in the closed position. Where the locking tab 150 is attached to the front wall 112 of the box of the container 100, the engagement edge is located on the inner side of the front wall of the lid 120. Alternatively, where the locking tab is attached to the inner side of the front wall of the lid 120, the engagement edge is located on the front wall 112 of the box of the container 100.

Figure 2:
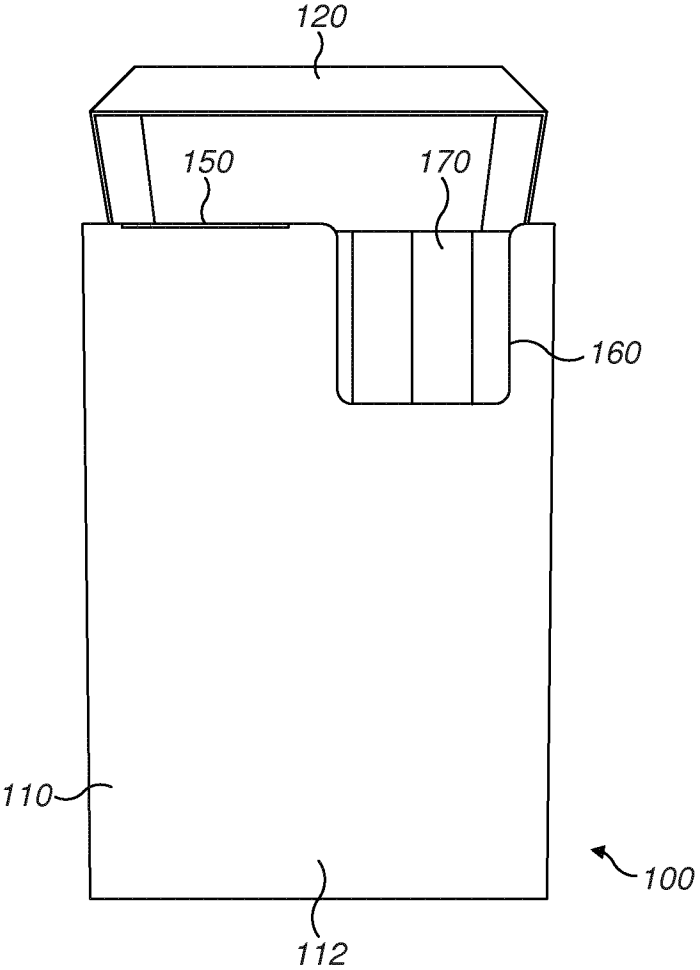
FIG. 2 is a front view of a container for smoking articles in accordance with the present invention.

FIG. 2 illustrates a front view of the exemplary container 100. Illustrated is the lid 120 in the open position biased away from the rear of the box 110 and the tongue 150 protruding from the front wall 112. Illustrated in this front view is a cut out portion 160 not previously visible in the side view of FIG. 1. The cut-out portion 160 facilitates easy removal of the smoking articles from the box 110. The cut-out portion 160 is a region at the top, open end of the front wall 112 of the box 110 extending partially along the top end of the front wall 112. The cut-out portion 160 extends downwardly from the top end to allow for a consumer to grasp a smoking article 170 from within the box 110.

As illustrated in the front view of FIG. 2, the tongue 150 extends only across the top end of the box 110 in the non-cut-out section. As described above, the locking mechanism 150 engages with a recess in the inner portion of the lid 120. The tongue 150 deforms against the wall of the lid 120 and when it is released a closing sound results, which improves user experience.

Figure 3:
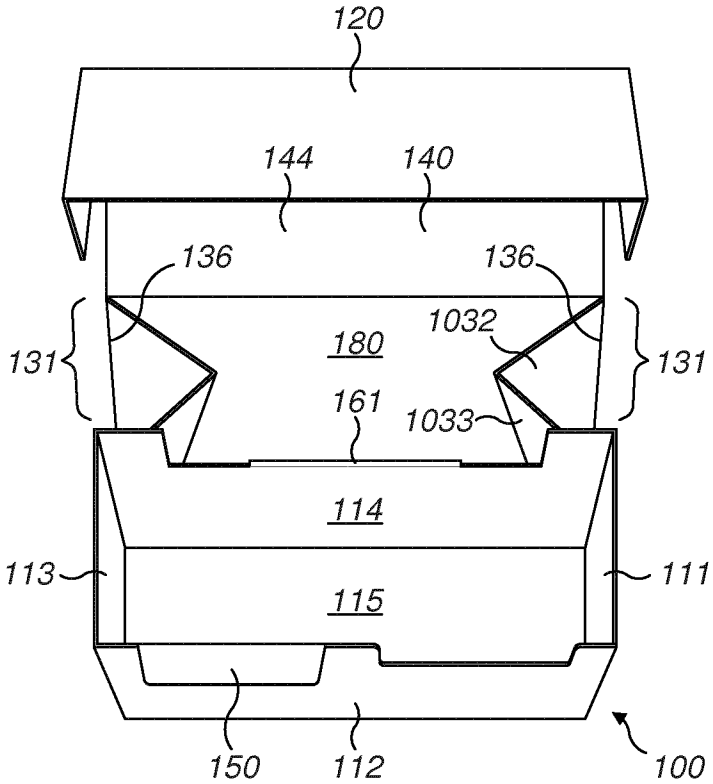
FIG. 3 is a perspective top view of a container for smoking articles in accordance with the present invention.

FIG. 3 illustrates a top view of the container 100. As shown in this view, the optional tongue 150 protrudes from the front wall 112 of the box. The box is formed of two side walls (or lateral walls) 111, 113, a front wall 112 and a rear wall 114 each connected to a base wall 115. The box 110 is for receiving consumer goods, particularly smoking articles, and has an open end at its top end. A cut-out portion 160 is provided in the front wall 112 to aid in retrieval of goods within the box. Similarly, extending substantially across the width of the rear wall 114 is a further cut-out portion 161 also to aid in retrieval of articles within the box 110.

The lid 120 is illustrated as attached to the hinged connector 140 and the container 100 is illustrated in the open position in which the hinged connector 140 has been moved away from the rear wall 114 of the box 110 by the resilient mechanism 130. From this top view of the box, the articulated panel structure 131 of the resilient mechanism 130 can be clearly seen. Each side of the rear wall of the box 110 is hingedly connected to a second panel 1033. Hinged to this panel 1033 is a first panel 1032 which is in turn hingedly connected to a side of hinged connector 140. Thus, at the base of the hinged connector 140 is a hinge line 143 with the box 110. At the top of the hinged connector 140 is a hinge line 142 with the lid 120. At each side of the hinged connector 140 is a hinge line 136 with a panel 1032 of the articulated panel structures 131 of the resilient mechanism 130. Illustrated in FIG. 3, each panel 1032, 1033 is arranged to hinge inwards and rotate about the hinge line 135 between the panels 1032, 1033 when the hinged connector 140 moves from the open position to the closed position. When the lid 120 is moved away from the closed position, the panels 1032, 1033 aim to return to a straight position so as to force the hinged connector 140 away from the rear of the box 110.

As shown in FIG. 3, the resilient mechanism 130, the rear wall 114 of the box 110 and the hinged connector 140 combine to define a pocket 180 which can be used to store promotional messages or other items. As illustrated in this top view, in the open position the inner face 144 of the hinged connector 140 is clearly visible to the consumer. Therefore the container 100 provides an additional surface in which messages can be displayed to the consumer when the container 100 is open, hidden from the consumer when the container 100 is closed. The pocket 180 can also be used as storage of small items such as pamphlets.

Together, the hinged connector 140 and resilient mechanism 130 add reinforcement to the structure without affecting the external visuals of the container 100. In the closed position the container 100 looks substantially similar to the container 100 expected by the consumer, that is, the resilient mechanism 130 is hidden between the rear wall 114 of the box 110 and the hinged connector 140. When in the closed position the hinged connector 140 appears to be the rear wall of the box 110.

Figure 4:
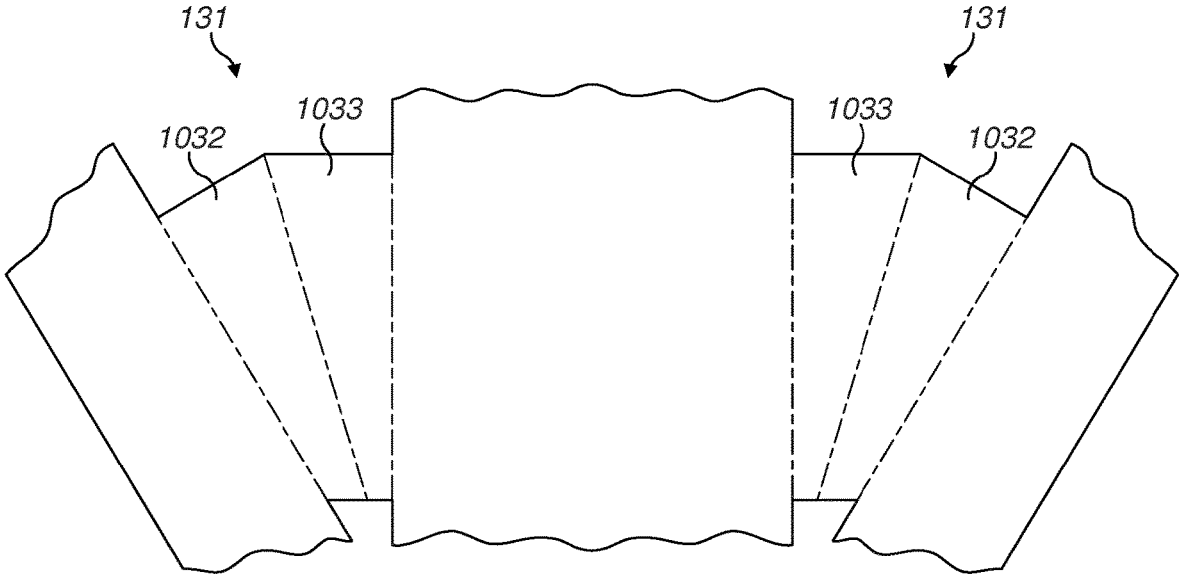
FIG. 4 schematically illustrates a portion of a blank which may be used to form a resilient mechanism for use in a container for smoking articles in accordance with the present invention.

FIG. 4 illustrates a schematic view of the articulated panel structure 131 forming the resilient mechanism 130 in this example. As mentioned, the first panel 1032 is attached or connected via a hinge 136 to the connector 140. The first panel 1032 is attached or connected to a second panel 1033 which in turn is attached or connected via a hinge 134 to the box 116. FIG. 4 illustrates both sides of the container. Preferably, the dimensions of each panel 1032, 1033 are substantially the same so as to provide for a symmetric overall container. FIG. 4 illustrates each hinge with dashed lines. Of course although it is illustrated that there may be two panels 1032, 1033, any number of articulated panels may be used to provide the resilient mechanism 130, such as in a concertina arrangement.

Figure 5:
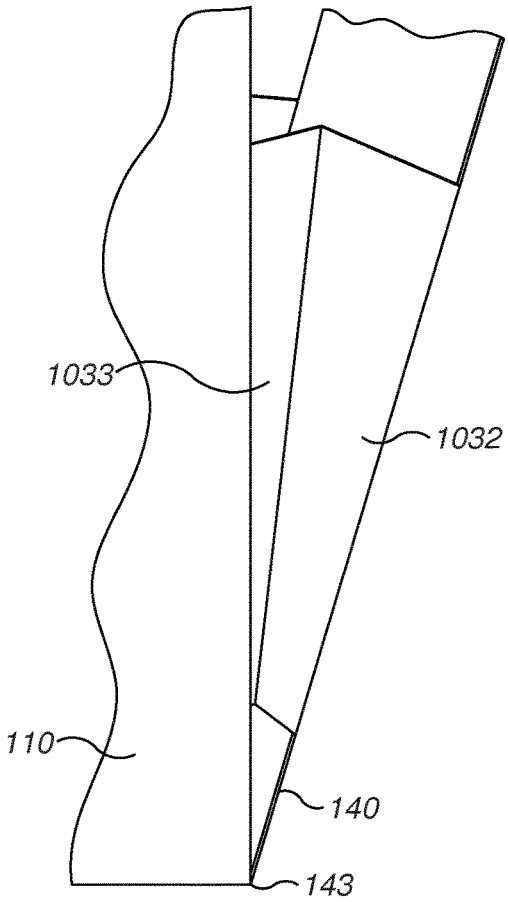
FIG. 5 shows a perspective side view of a resilient mechanism of a container for smoking articles in accordance with the present invention.

FIG. 5 further illustrates the panel structure 131 and the hinge 143 at the base of the hinged connector 140. As shown in FIG. 5, to allow for the hinged connector 140 to move away from the box 110, the panels 1032, 1033 do not extend along the entirety of the side of the hinged connector 140 but are only attached at a portion of the side so as to effectively move the hinged connector 140 away from the box 110. Thus, a gap is defined between the hinged connector 140, the rear wall of the box 110 and the bottom of the articulated panels 1032, 1033.

FIG. 6 once again shows schematically the articulated panel structure 131 and the hinged connector 140. In this example, the width c of the hinged connector 140 is the same as the width of the box 110. As illustrated, the angle of opening $\propto$, that is the extent to which the hinged connector 140 is able to move away from the rear of the box 110, is a function of the sum of the widths b of the top edges of the panels 1032, 1033.

Figure 6:
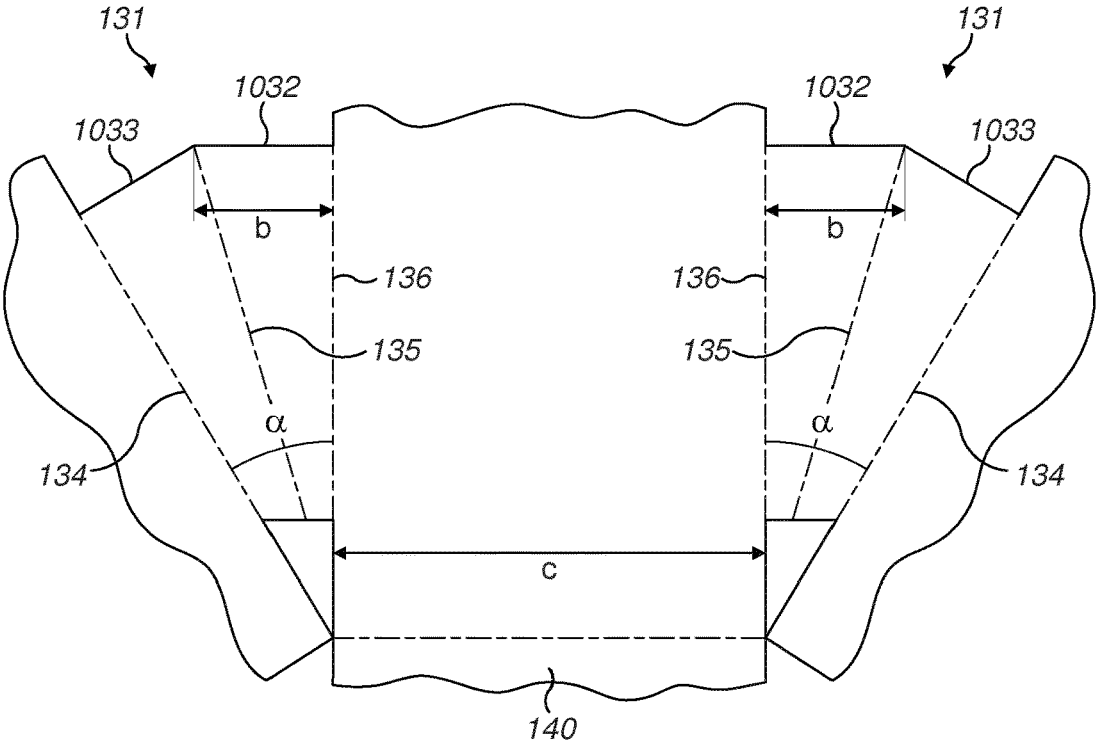
FIG. 6 schematically illustrates a portion of a blank which may be used to form an articulated panel structure for use in a container for smoking articles in accordance with the present invention.

In the example of FIG. 6, each panel is shown to have substantially the same dimensions but this may not necessarily be the case. Preferably, the angle of opening $\propto$ is 32 degrees and can be a minimum of 10 degrees. The width b of the top edge of the panel is preferably between 10 mm and half the width of the rear wall of the box 110. That is, when in the closed position, the folded panels when each are folded between the rear wall of the box and the hinged connector, do not overlap. Accordingly, in the folded, closed position, the visibility of the articulated panels 1032, 1033 is minimal.

The above described illustrations make it clear that the first panel 1032 is hingedly connected to the second panel 1033 along a panel-panel hinge line 135. The panel-panel hinge line 135 is at a first angle with respect to the panel-connector rotation axis 136, the panel-panel hinge line 135 is at a second angle with respect to the panel-box rotation axis 134, and the first and second angles are substantially the same.

Figure 7A:
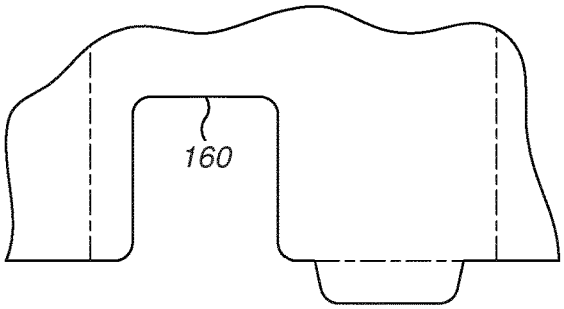
FIG. 7A schematically illustrates a portion of a blank which may be used to form a front wall of a box portion for use in a container for smoking articles in accordance with the present invention.
Figure 7B:
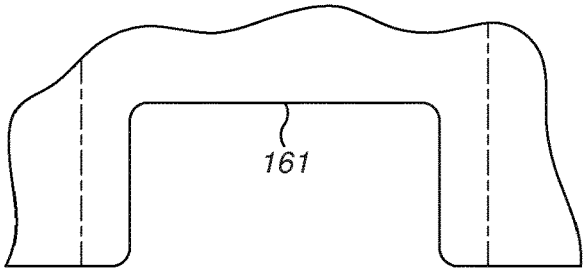
FIG. 7B schematically illustrates a portion of a blank which may be used to form a rear wall of a box portion for use in a container for smoking articles in accordance with the present invention.
Figure 8:
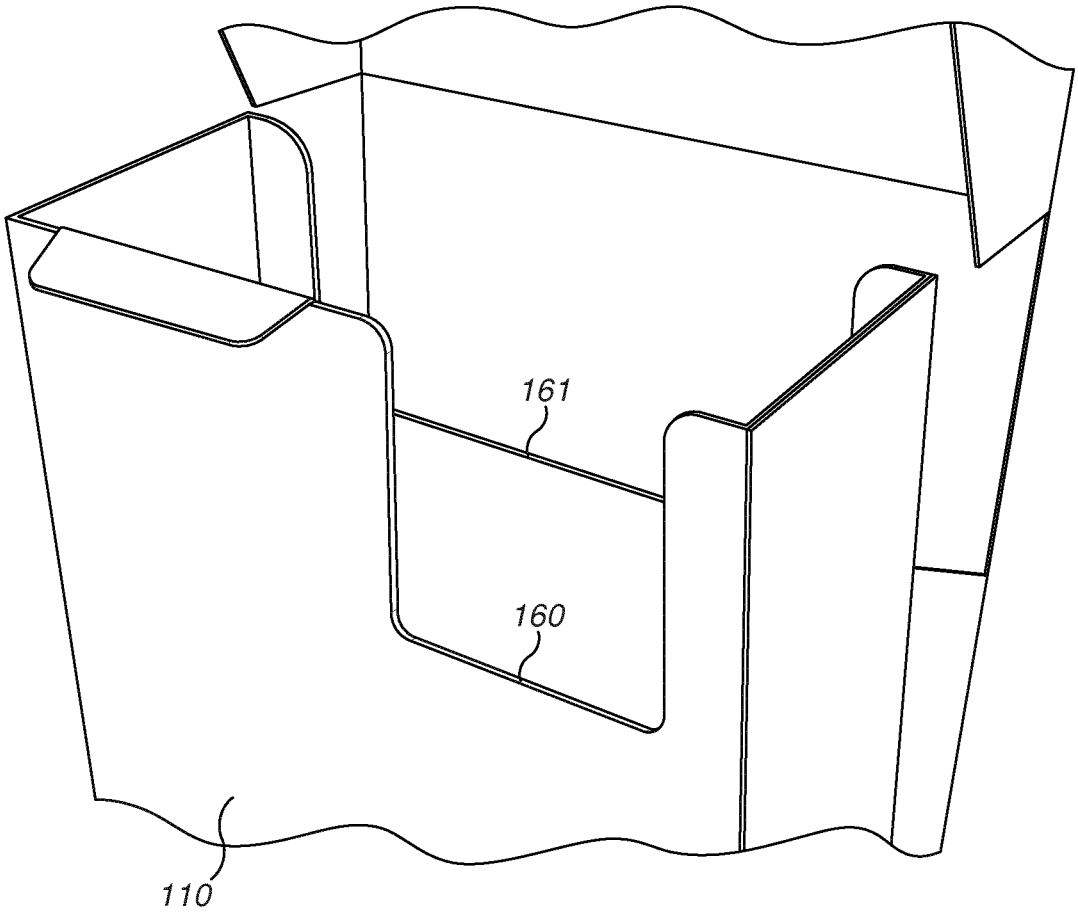
FIG. 8 shows a perspective front view of a top end of a container for smoking articles in accordance with the present invention.

FIGS. 7A and 8 illustrate an optional cut-out portion 160 of the front wall 112 of the box 110, while FIGS. 7B and 8 illustrate an optional cut-out portion 161 of the rear wall 114 of the box 110. FIG. 7 illustrates a view of the front wall 112 before being formed into a box 110. Illustrated in 7A is the front wall 112 and illustrated in 7B is the rear wall 114. As illustrated in 7A, the cut-out portion 160 extends across half the width of the top edge of the front wall 112 while in FIG. 7B a cut-out portion 161 extends across most of the top edge of the rear wall 114. As shown, the cut-out portions 160, 161 have substantially curved corners to improve user experience. The depth of the cut-out portion may be set according to the article held within the box so that it can be extracted without damaging the article. Where the container 100 houses filtered cigarettes, these are typically arranged with the filter end exposed at the top, open end of the box 110 to prevent damage of the tobacco rod when the consumer pinches the cigarette to extract it. In such case, the depth of the cut-out portion is set so as to expose only the filter, preferably only a portion of the filter, such as 80% of the length of the filter or less. For 84 mm filtered cigarettes the preferred depth is about 21 mm, while for 100 mm filtered cigarettes the depth may be set at a maximum of 30 mm.

In all of the example containers 100 described, some or all of the component parts can be structurally integral with each other. Typically, for example, component parts such as the box 110, lid 120, resilient mechanism 130 and hinged connector are all integral with each other. In other examples, only the box 110 and the lid 120 are integral with each other. In fact, any combination of component parts of the container 100 can be arranged to be integral with each other.

By 'integral', we of course intend to mean that the various component parts are formed from a single continuous body of material which is assembled, for example by scoring or folding sections of the body. In other words, when two component parts are said to be integral, they constitute a unitary body of material, which does not require the application of adhesives or joining members to join the two component parts together. Such an arrangement can be achieved for example by having the various components formed from a single blank, an example of which is shown in FIG. 9.

FIG. 9 illustrates a blank 1000 which may be used to form a container 100 of the present invention as illustrated in FIG. 1. The blank 1000 comprises a first portion 1010 for forming the box 110, a second portion 1020 forming the lid 120 and an intermediate portion 1030, including a connector portion 1040 for forming the hinged connector 140 and also including a plurality of panels for forming the resilient mechanism 130 or articulated panel structure.

The box portion 1010 of the blank 1000 comprises a plurality of panels including a box front panel 1012 for forming the front wall 112 of the box 110, a first box side panel 1011 for forming one of the side walls 111 of the box 110, a second box side panel 1013 for forming another one of the side walls 113 of the box 110, a box bottom panel 1015 and two box bottom tabs 1016, 1017 for forming the bottom end wall 115 of the box 110, and two box rear panels 1014*a*, 1014*b* for forming the rear wall 114 of the box 110.

The box front panel 1012 is connected to the first box side panel 1011 by a fold line on one side of the panel 1012 and to the second box side panel 1013 by a fold line on the opposite side of the box front wall panel 1012. The box front panel 1012 is further connected to the box bottom panel 1015 by a fold line on another side of the panel 1012. Each of the first and second box side panels 1011, 1013 is connected by a fold line to a respective box rear panel 1014*a*, 1014*b* at the opposite side of the box side panel 1011, 1013 from the connection to the box front panel 1012. At another side of each box side panel 1011, 1013, the side adjacent the box bottom panel 1015, is connected, by a fold line, the respective bottom tab 1016, 1017.

Connected to the box front panel 1012 by a fold line is a tongue 150 for engagement with the lid 120, particularly with an edge of a lid side tab 1025*b*. The box front panel 1012 has a cut-out 1060 formed in the box front panel 1012 to ease access to goods. Each of the first and second box rear panels 114*a*, 114*b* comprises a cut-out 1061 to ease access to the goods such that each of the first and second box rear panels 1014*a*, 1014*b* is formed substantially as an L shape with the longest side being connected by the fold line to the respective first and second box side panels 1011, 1013.

The intermediate portion 1030 of the blank 1000 comprises a plurality of panels, including a connector panel 1041 for forming the hinged connector 140, a first articulated panel structure portion 1031 comprising first and second articulated panels 1032, 1033, and a second articulated panel structure portion 1031 comprising respective first and second articulated panels 1032, 1033. Each articulated panel structure portion 1031 further comprises an attachment tab 1037, 1038 for connecting the articulated panel structure 131 to a respective side wall 111, 113 of the box 110. The attachment tabs 1037, 1038 are shaped to correspond with the side panels 1011, 1013 of the box portion 1010 to form an outer layer of the box 110.

The connector panel 1041 is connected to the box bottom panel 1015 by a fold line on one side of the panel 1041, the fold line forming a connector-box hinge line 143. At another side of the connector panel 1041, at a side adjacent the connector-box hinge line 143, is connected, by a fold line, a first panel 1032 of a first articulated panel structure portion 1031. At the opposite side of the connector panel 1041 is connected a first panel 1032 of a second articulated panel structure portion 1031, also formed by a fold line. Thus, a panel-connector hinge line 136 is formed by the fold line between the connector panel 1041 and the respective first panel 1032, 1032 of the first and second articulated structure portions 1031, 1032. Preferably the first panels 1032 of the first and second articulated panel structure portions 1031 have identical dimensions. The articulated panel structure portions 1031 form part of a resilient mechanism 130 articulately mounted to the hinged connector 140 and the box 110. Each first panel 1032 is connected on one side, by a fold line, to the connector panel 1041 along a panel-connector rotation axis 136 and is connected on another side, by a fold line, to a respective second panel 1033 of the articulated panel structure portions 1031 along a panel-panel hinge line 135. Each second panel 1033 is in turn connected on one side, by a fold line, to its respective attachment tab 1037, 1038 along a panel-box rotation axis 134.

The lid portion 1020 of the blank 1000 comprises a plurality of panels, including a lid front panel 1021 for forming the front wall of the lid 120, a first lid side panel 1022 for forming one of the side walls of the lid 120, a second lid side panel 1023 for forming another of the side walls of the lid 120 and a lid top panel 1024 for forming the top wall of the lid 120.

The lid front panel 1021 is connected to the lid top panel 1024 by a fold line on one side of the panel 1021. The opposite side of the lid top panel 1024 is connected to the connector panel 1041 by a fold line, at a side of the connector panel 1041 opposite the connection to the box bottom panel 1015, forming a connector-lid hinge line 142. The panel-connector rotation axis 136 is substantially perpendicular to the connector-lid hinge line 142. The connector-lid 142 and connector-box 143 hinge lines are substantially parallel to each other. Another side of the lid top panel 1024 is connected to a first lid side panel 1022 by a fold line. The opposite side of the lid top panel 1024 is connected to a second lid side panel 1023 by a fold line. The lid portion 1020 of the blank 1000 further comprises side tabs 1025, 1026 for connecting the lid side panels 1022, 1023 to the lid front panel 1021. In this embodiment the side tabs 1025, 1026 are connected to the respective lid side panel 1022, 1023 by a fold line. An edge of side tab 1025 is the engagement edge against which the tip of the tongue 150 is designed to engage in the lid closed position.

Optionally, not shown, the lid portion 1020 may comprise a lid rear panel connected to the lid top panel 1024 by a fold line on a side of the lid top panel 1024 which is opposite the fold line connecting the lid front panel 1021 to the lid top panel 1024 and between the lid top panel 1024 and the connector panel 1041.

To form the container 100 from the blank 1000, each of the panels and tabs is folded about the respective fold lines that connect them with other panels and tabs of the blank. Unless otherwise specified, panels and tabs are folded about the respective fold lines approximately 90 degrees and tabs are connected, for example by gluing, to the inner surface of panels.

The box 110 of the container 100 is formed from the box portion 1010 of the blank 1000 by folding all tabs and panels about their fold lines approximately 90 degrees. Folding of the first and second rear panels 1014*a*, 1014*b* around their respective fold lines causes the free edges (of the first and second rear panels 1014*a*, 1014*b*) that are opposite the fold lines to become adjacent to each other, preferably without overlap. The bottom tabs 1016, 1017 are attached (glued) to the inner side of the bottom panel 1015 to form the bottom wall 115. With the tabs and panels of the box portion 1010 of the blank 1000 inter-attached in this manner, the structure of the box 110 of the container 100 is formed.

The intermediate portion 1030 of the container 100 is formed as follows. The connector panel 1041 is folded about the connector-box hinge line 143. The inner surface of the first attachment tab 1037 is adhered to the outer surface of the first box side wall 111. Similarly, the second attachment tab 1038 is adhered to the outer side of the box side wall 113. The first and second panels 1032, 1033 of the first and second articulated panel structure portions 1031 are folded inwardly so as to sit between the connector panel 1041 and the rear wall 114 of the box 110 when the hinged connector panel 1041 is moved towards the box 110 about the connector-box hinge line 143. Preferably, these panels 1032, 1033 are folded about the panel-panel hinge line 135 approximately 180 degrees.

The lid 120 of the container 100 is formed from the lid portion 1020 of the blank 1000 by folding all tabs and panels about their fold lines approximately 90 degrees. The side tabs 125, 126 are attached (e.g. glued) to the inner side of the lid top panel 1024 to form the top wall of the lid 120. With the tabs and panels of the lid portion 1020 of the blank 1000 inter-attached in this manner, the structure of the lid 120 of the container 100 is formed.

Whilst the blank shown in FIG. 9 forms the container 100 and has been shown with a particular size, shape and configuration of panels and tabs, it will be appreciated that minor changes may be made to these sizes, shapes and/or configuration as is well known in the field of geometric nets. For example, where a tab is used to connect one panel to another panel, generally that tab may be connected via a fold line to either of the two panels on the edge of that panel which is connected to the other panel. Similarly, a panel that is connected via a fold line to another panel in the blank may be changed so that the panel is moved to another location on the blank and a tab is used to connect the two panels together when the blanks are folded.

An example of an alternative blank is shown in FIG. 10. FIG. 10 illustrates a box portion 1010 of the blank 1020 having one rear panel 1014*c* instead of two. The box portion further comprises a tab 1018 connected, by a fold line, to the rear panel 1014*c* for connecting the rear panel 1014*c* to the side panel 1011 to form the box 110. The intermediate portion 1030 and lid portion 1020 are substantially similar.

FIG. 11 illustrates an alternative example container 200. The container 200 similarly embodies the principle of a box 210 and a hinged lid 220 which is biased away from an open end of the box 210 in an open position using an integral resilient mechanism hidden from the consumer in a closed position.

FIG. 11 shows a container 200 for smoking articles in accordance with the present invention. A container 200 is shown having a box 210 which receives the goods in question. To close the top, open end of the box 210 there is provided a lid 220. Since FIG. 11 is a perspective side view of the container, only certain walls of the box 210 are shown, such as a side wall 211.

The lid 220 is hingedly connected to the box 210 of the container 200 via a hinged connector 240. The lid comprises a plurality of side walls as well as a top wall. One of the side walls forms the front wall of the lid 220. In the illustrated example of FIG. 11, the hinged connector 240 is hinged to a rear wall of the lid 220 along a connector-lid hinge line 242.

As mentioned, the hinged connector 240 is arranged between the box 210 and the lid 220. In the illustrated example, the hinged connector 240 is integral with both the box 210 and the lid 220. In the example, the hinged connector 240 is formed of a rear wall hingedly connected to the box 210 and two side walls, each of which are shaped to correspond with the side walls 211 of the box 210. The hinged connector 240 is also hinged to the lid 220 so that the lid may be rotated around the lid hinge. The two hinges allow for rotational movement of the hinged connector 240 and the lid 220 about the front edge of the base of the box 210 and the lid 220 to rotate about the top end of the hinged connector 240. The two rotations allow the lid 220 to move between a closed position in which the lid 220 closes the top, open end of the box 210 and an open position in which the lid 220 does not close the top, open end of the box 210.

Hidden from view in the perspective view of FIG. 11 is a resilient mechanism 230 arranged between the rear wall of the box 210 and the lid 220. The resilient mechanism 230 is attached or connected to the rear wall of the box 210 and the inside of the rear wall of the lid 220. The resilient mechanism 230 causes relative movement of the hinged connector 240 away from the box 210. That is, the resilient mechanism 230 biases the lid 220, and therefore the hinged connector 240, away from the box 210. Thus, when the lid 220 is manually moved by a consumer away from a closed position, the resilient mechanism 230 moves the lid 220 in a rotational manner about the hinged connector 240 and in turn moves the hinged connector 240 away from the box 210, or the box 210 away from the hinged connector 240 depending on which is being held in place by the consumer.

FIG. 11 further illustrates that the hinged connector 240 includes two side walls shaped to correspond to the side panels of the box 210. In this way, the side panels of the connector 240 substantially hide or receive the box 210 in the closed position. The inner surface of the rear wall of the connector 240 and the side walls and rear wall of the box 210 are therefore all hidden when the container 200 is in the closed position, thus providing increased communication space to the consumer when in the open position.

Figure 13:
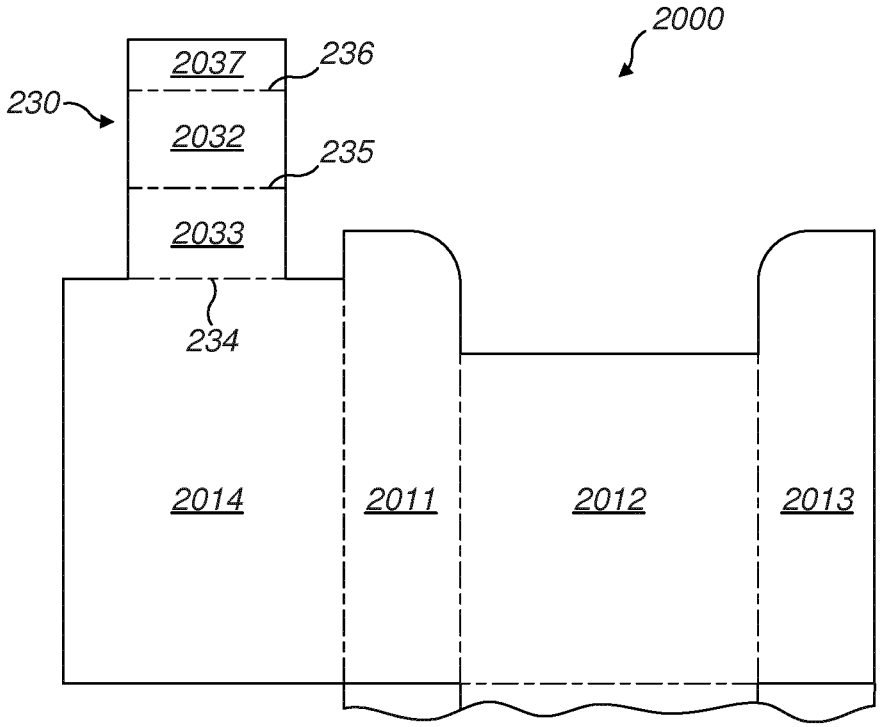
FIG. 13 schematically illustrates a portion of a blank which may be used to form a resilient mechanism for use in a container for smoking articles in accordance with the present invention; and, FIG. 14 schematically illustrates a blank which may be used to form the container of FIGS. 11 and 12.

As illustrated in FIG. 13, the side walls of the connector 240 may be double layered. FIG. 13 illustrates that the outer layer of the wall may not extend to the full height of the inner layer and may instead be arranged to abut the lid 220 when the lid 220 is closed over the inner layer of the double-layered side walls. The portion of the inner layer that protrudes beyond the outer layer is arranged to provide friction against the inner surface of the side walls of the lid 220 and accordingly prevent inadvertent lid opening.

An advantage of this example is that the multiple rear and side walls of the container, when closed, provide robust support to the container to substantially reduce inadvertent deformation of the container and the articles stored within the container. As a result, presence of an inner frame that surrounds a part of the bundle of smoking articles is not needed as the container is robust enough to prevent damage of the contents. Of course such an inner frame may still be provided, if desirable.

FIG. 11 illustrates that the articles may be housed within a resealable pack of consumer goods. The inner pack 290 may be held within the box 210. The resealable pack may include a label 291 which is attached to an inner wall of the lid 220 so that when the lid is opened, the label 291 moves away from an opening of the inner pack 290. Such resealable packs and labels are known in the art.

Figure 12:
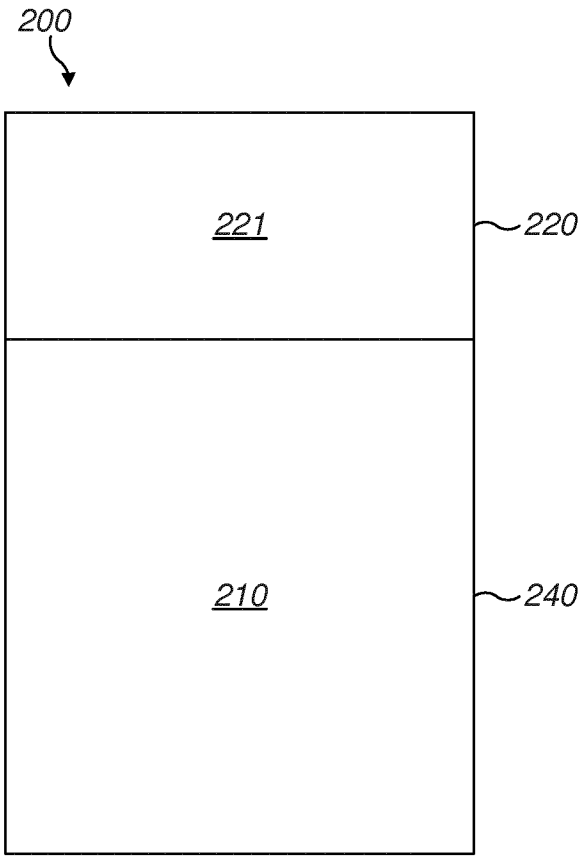
FIG. 12 is a front view of the container of FIG. 12.

FIG. 12 shows a front view of the container 200 in a closed position. The box 210 is substantially housed within the hinged connector 240 so that only the front wall of the box 210 is visible. The lid 220, when closed, covers the top, open end of the box 210 and the front wall 221 of the lid 220 sits in line with the front wall of the box 210. The side walls of the lid sit flush with the side walls of the connector 240 as illustrated. As described above, the second or outer side panel of the double-layered side wall of the hinged connector 240 abuts the side wall of the lid 220 so that the walls sit flush. As will be clear from FIG. 12, the container 200 appears to the consumer to be similar to conventional containers. In practice however, the resilient mechanism 230 and hinged connector 240 together provide an improved container 200 with improved opening such that only one hand is required to open the lid 220 of the container 200.

The hinged connector 240 adds reinforcement to the structure of the container 200 without affecting the external visuals of the container 200. In the closed position the container 200 looks substantially similar to the container expected by the consumer, that is, the resilient mechanism 230 is hidden between the rear wall of the box 210 and the hinged connector 240. When in the closed position the hinged connector 240 appears to be the rear wall of the box 210.

FIG. 13 illustrates a portion of a blank 2000 which may be used to form the container 200 of FIGS. 11 and 12. The resilient mechanism 230, hidden from view in the perspective view of FIG. 11, is now visible. The resilient mechanism 230 includes two panels 2032, 2033 which together form an articulated panel structure, and an attachment tab 2037. A first panel 2032 is attached to the lid 220 via the attachment tab 2037, preferably attached to a rear wall of the lid 200. Accordingly, the articulated panel structure is hinged to the lid 220. A second panel 2033 of the articulated panel structure is attached to the first panel 2032 by a fold line and in turn attached, by a fold line, at an opposite side to a rear panel 2014 of the box 210.

When the attachment tab 2037 is attached to the rear wall of the lid 220, the articulated panel structure forms multiple hinge lines. The first panel 2032 is hinged to the lid 220 to form a panel-connector hinge line 236. The panels 2032, 2033 are each hinged to each other to form a panel-panel hinge line 235. The second panel 2033 is hinged to the box 210 to form a panel-box hinge line 234. Each of the hinge lines 234, 235, 236 are parallel to one another. Accordingly, the articulated structure comprises at least two panels, a first panel 2032 rotatably mounted to the hinged connector 240 along a panel-connector rotation axis 236, and a second panel 2033 rotatably mounted to the box 210 along a panel-box rotation axis 234.

When the container 200 is in the closed position, the panels 2032, 2033 are folded inwardly toward the bottom of the container 200 so that the two panels 2032, 2033 each lie substantially parallel to each other as well as to the rear wall of the box 210 and to the rear wall of the hinged connector 240. The panels 2032, 2033 sit alongside one another. The panel-connector and panel-box rotation axes 236, 234 are substantially parallel to each other when the lid 220 is in the closed position. As the lid 220 moves away from the open end of the box 210, the first and second panels 2032, 2033 move away from each other and rotate about the panel-panel hinge line 235 caused by tension in the fold. The panel-connector and panel-box rotation axes 236, 234 remain substantially parallel to each other during movement of the lid 220 between the open and closed positions. Further the panel-connector rotation axis 236 is substantially coincident with the connector-lid hinge line 242. Moreover the panel-panel hinge line 235 is substantially parallel to the panel-connector rotation axis 236 and to the panel-box rotation axis 234 during movement of the lid 220 between the open and closed positions. During movement between the closed and open positions, the panels 2032, 2033 move from a parallel arrangement with the rear wall of the box 210 toward a perpendicular arrangement. In this example, however, the label 291 may impede the panels 2032, 2033 from reaching the perpendicular arrangement with the rear wall of the box 210 and therefore may remain at an angle in the lid open position.

It will be understood of course that the panel structure may include any number of panels 2032, 2033 arranged to move the hinged connector 240 and box 210 away from each other. This example includes a single articulated panel structure extending along a part of the top edge of the rear wall of the box 210. There may be multiple articulated panel structures or alternatively the panel structure may extend across the entire width of the rear wall of the box 210. In a further example, one of the panels may be attached to a surface of the rear wall of the box or the rear wall of the hinged connector. If only two panels are included in such a panel structure, only the other panel may move toward the perpendicular.

Each of the panels 2032, 2033 of the articulated panel structure are substantially identical in the illustrated example but this is not essential. Each example panel 2032, 2033 has a rectangular shape to maintain the hinge lines 234, 235, 236 parallel to one another so that each rotation axis is substantially parallel and accordingly the lid 220 moves in a smooth motion away from the open position.

When the hinged connector 240 is pushed toward the box 210, the panels 2032, 2033 fold inwardly between the hinged connector 240 and the rear wall of the box 210. The panel structure is arranged so as to bias the hinged connector 240 outwardly. The hinges 234, 235, 236 of the panel structure are configured to be resilient so as to revert to a straight configuration after folding inwardly when not held in place by the closure of the lid 220. The skilled person would understand that one or more of the hinge lines of the panel structure may be configured to be resilient to move the hinged connector outwardly away from the box and straighten the panel structure.

When the lid 220 is in the closed position, rotation of the lid 220 about the hinge line 242 between the hinged connector 240 and the lid 220 is prevented by the walls of the box 210. As such, the panels remain folded and the box 210 remains housed within the hinged connector 240. The consumer moves the lid 220 away from the open end of the box 210. Once free from the box 210, the resilient mechanism 230 moves the lid 220 further away from the open end of the box 210 as the box 210 no longer prevents movement. The hinges unfold toward a straight position and the connector 240 and box 210 rotate away from each other about the hinge line 243 between the connector 240 and the box 210 to an open position.

Alternative arrangements to move the hinged connector 240 and box 210 away from each other, such as a spring or other resilient mechanism fixed between the hinged connector or lid and the box are contemplated. For example, a cardboard spring or torsion spring may be attached to a rear wall of the box 210 and an inner surface of the connector 240 to move the two away from each other. In the example described in detail here, the resilient mechanism 230 is formed of an articulated panel structure attached to the lid 220 and box 210. With the lid 220 attached to the hinged connector 240, the lid 220 and hinged connector 240 can be moved away from the box 210 by the resilient mechanism 230. The mechanism 230 could be attached to the hinged connector 240 rather than the rear wall of the lid 220 to perform the same function. Further, the rear wall of the lid 220 may not be present and the hinged connector 240 act as the rear wall and accordingly the panel structure could be attached or connected to the connector 240 in this arrangement. The panel structure could of course be connected to the connector 240 even if a rear wall of the lid 220 is present.

Also illustrated in FIG. 13 are side panels 2011, 2013 of the box and a front panel 2012, each of which will be described in more detail below. It will be noted however that the side panels 2011, 2013 are rounded at the top, front end to smooth motion during lid opening.

Locking mechanisms as described above in the context of the first example may, of course, be provided.

FIG. 15 illustrates a complete blank 2000 which may be used to form a container 200 of the present invention as illustrated in FIG. 11. The blank 2000 comprises a box portion 2010 for forming the box 210 of the container 200, a lid portion 2020 for forming the lid 220, a connector portion 2040, for forming the hinged connector 240, and a resilient mechanism portion 2030, for forming the resilient mechanism 230 or articulated panel structure.

The box portion 2010 of the blank 2000 comprises a plurality of panels including a box front panel 2012 for forming the front wall of the box 210, a first box side panel 2011 for forming one of the side walls of the box 210, a second box side panel 2013 for forming another one of the side walls of the box 210, and a box rear panel 214 for forming the rear wall of the box 210.

The box front panel 2012 is connected to the first box side panel 2011 by a fold line on one side of the panel 2012 and to a second box side panel 2013 by a fold line on the opposite side of the box front panel 2012. Each of the side panels 2011, 2013 is longer in a longitudinal direction than the box front panel 2012 and has a rounded corner at the side connected to the box front panel 2012. The rounded corner is not connected to the box front panel 2012.

The box rear panel 2014 is connected by a fold line to either of the box side panels 2011, 2013.

The connector portion 2040 of the blank 2000 comprises a plurality of panels, including a connector rear panel 2041 for forming the rear wall of the hinged connector 240, and a container bottom panel 2015 and two bottom tabs 2016, 2017 for forming the bottom wall of the connector 240, which corresponds to the bottom wall of the closed container 200. The connector portion 2040 includes a first connector inner side panel 2044, a second connector inner side panel 2045, a first connector outer side panel 2046 and a second connector outer side panel 2047 which together form the side walls of the hinged connector 240.

The container bottom panel 2015 is connected by a fold line to the box front panel 2012, the fold line forming a connector-box hinge line 243. The opposite side of the container bottom panel 2015 is connected to the connector rear panel 2041 by a fold line. Another side of the connector rear panel 2041 is connected by a fold line to a first outer side panel 2046. The opposite side of the connector rear panel 2041 is connected by a fold line to a second outer side panel 2047. In this example, the first and second outer side panels 2046, 2047 are, optionally, substantially right-angled trapezium shaped and the longer base of each trapezium is connected to the connector rear panel 2041. The angle and length of the diagonal legs are configured to cooperate with the diagonal legs of the lid side panels 2022, 2023.

The right-angled legs of the first and second outer side panels 2046, 2047 are connected by a fold line to first and second connector bottom tabs 2016, 2017, respectively. The right-angled leg being a side of the first and second outer side panels 2046, 2047 proximal to the box portion 2010, that is, proximal to the body side panels 2013, 2011. The diagonal side of the first and second outer side panels 2046, 2047 being distal to the box portion 2010.

The opposite side to the connector rear panel 2041 of the first and second outer side panels 2046, 2047 is connected to first and second inner side wall panels 2044, 2048, respectively, by a fold line. Each of the first and second inner side panels 2044, 2045 substantially mirrors the first and second box side panels 2011, 2013, respectively. That is, each of the first and second inner side panels 2044, 2045 has a rounded corner proximal to the connector rear panel 2041 and distal to the box portion 2010 or box front panel 2012.

The opposite side of the connector rear panel 2041 to the container bottom panel 2015 is connected to a rear panel 2027 of the lid 220 by a fold line which will be described in more detail below.

The lid portion 2020 of the blank 2000 comprises a plurality of panels, including a lid front outer panel 2021*a* and a lid front inner panel 2021*b* for forming the front wall of the lid 220, a first lid side panel 2022 for forming one of the side walls of the lid 220, a second lid side panel 2023 for forming the other one of the side walls of the lid 220, a lid top panel 224 for forming the top wall of the lid 220, and a lid rear panel 2027 for forming a rear wall of the lid 220. The lid portion 2020 of the blank 2000 further comprises two side tabs 2028, 2029 for connecting the lid side panels 2022, 2023 to the lid rear panel 2027, and two top tabs 2025, 2026 for connecting the lid side panels 2022, 2023 to the lid top panel 2024.

The lid rear panel 2027 is connected by a fold line to the connector rear panel 2041 at an opposite side to the container bottom panel 2015. The fold line forms a connector-lid hinge line 242. The opposite side of the rear panel 2027 is connected by a fold line to the lid top panel 2024. The opposite side of the lid top panel 2024 is connected by a fold line to the lid front outer panel 2021*a*. The opposite side of the lid front outer panel 2021*a* is connected by a fold line to the lid front inner panel 2021*b*.

Another side of the lid rear panel 2027 is connected by a fold line to the first lid side tab 2028. The opposite side of the lid rear panel 2027 is connected by a fold line to the second lid side tab 2029. The first lid side tab 2028 is connected by a fold line to the first lid top tab 2025 at the side of the first side tab 2028 distal to the connector-lid hinge line 242, adjacent to the lid top panel 2024 and proximal to the lid front outer panel 2021*a*. The second lid side panel 2029 is connected by a fold line to the second lid top tab 2026 at the side of the second lid side tab 2029 distal to the connector-lid hinge line 242, adjacent to the lid top panel 2024 and proximal to the lid front outer panel 2021*a*.

The lid side tabs 2028, 2029 are each substantially smaller than the lid side panels 2022, 2023 so as to be externally invisible when the container 200 is formed. In this example, the lid side panels 2022, 2023 are substantially right-angled trapezium shaped with the diagonal leg of the trapezium being distal to the connector-lid hinge line 242 and the longest base of the lid side panels 2022, 2023 being connected to the lid front outer panel 2021*a* so that when formed into a container 200, the side is angled upwardly from the front to the rear of the container 200. The angle and length of the diagonal leg is configured to cooperate with the connector outer side panel 2046, 2047.

One exemplary lid portion is described in detail but it will be clear that the type of lid is not essential and any suitable lid structure known in the art may be used with the invention. For example, the lid may not include a rear wall and the connector rear panel 2041 may be hinged directly to the lid top panel 2024 in a similar manner to the lid described in the first example above. The connector-lid hinge line 242 remains parallel to the connector-box hinge line 243 and the lid rotates around the connector-lid hinge line 242.

The resilient mechanism portion 2030 of the blank 2000 is formed as an articulated panel structure and comprises a plurality of panels, including a first panel of the articulated panel structure 2032, a second panel of the articulated panel structure 2033 and an attachment tab 2037.

The second panel of the articulated panel structure 2033 is connected by a fold line at one side to a side of the box rear panel 2014 distal to the container bottom panel 2015 and adjacent, in this example, to the first box side panel 2011. The fold line forms a panel-box hinge line 234. The opposite side of the second panel of the articulated panel structure 2033 is connected by a fold line to the first panel of the articulated panel structure 2032 forming a panel-panel hinge line 235. The opposite side of the first panel of the articulated panel structure 2032 is connected by a fold line to the attachment tab 2037, forming a panel-connector hinge line 236 in the assembled container 200 in which the attachment tab 2037 is attached to the lid rear panel 2027. Each of the panel-box hinge line 234, the panel-panel hinge line 235 and the panel-connector hinge line 236 are parallel to one another in this example in both the open and closed positions. Thus, the first panel 2032 is rotatably mounted to the connector 240 along a panel-connector rotation axis 236 and the second panel 2033 is rotatably mounted to the box 210 along a panel-box rotation axis 234. The panels 2032, 2033 each have substantially identical dimensions but this is not essential and does not materially affect the appearance of the container 200 in either the open or closed positions in this example. The panels 2032, 2033 of the articulated panel structure are not otherwise connected to other elements of the container 200.

To form the container 200 from the blank 2000, each of the panels and tabs is folded about the respective fold lines which connect them with other panels and tabs of the blank. Unless otherwise specified, panels and tabs are folded about the respective fold lines approximately 90 degrees and tabs are connected, for example by gluing, to the inner surface of panels.

The hinged connector 240 of the container 200 is formed from the connector portion 2040 of the blank 2000 as follows. The bottom tabs 2016, 2017 are adhered to the inner side of the container bottom panel 2015 to form the bottom wall of the connector 240. Each inner side panel 2044, 2045 is folded approximately 180 degrees about the fold line between the inner side panel 2044, 2045 and the respective outer side panel 2046, 2047. Optionally, the respective inner and outer side panels 2044, 2046 (2045, 2047*b*) are adhered. This increases the robustness of the container 200, but is not essential.

The lid 220 of the container 200 is formed from the lid portion 2020 of the blank 2000 as follows. The first lid side tab 2028 is adhered to the inner side of the first lid side panel 2022 to form the first side wall of the lid 220. Similarly, the second lid side tab 2029 is adhered to the inner side of the second lid side panel 2023 to form the second side wall of the lid 220. The two top tabs 2025, 2026 are adhered to the inner side of the lid top panel 2024 to form the top wall of the lid 220. Finally, the lid front inner panel 2021*b* is folded approximately 180 degrees about the fold line between the lid front inner panel 2021*b* and the lid front outer panel 2021*a*, which are adhered to form the front wall of the lid 220.

The box 210 of the container 200 is formed from the box portion 2010 of the blank 2000 by folding the panels about their fold lines approximately 90 degrees without adhering any panels therebetween. Therefore, once the box 210 is formed, the free longitudinal edge of the rear panel 2014 is adjacent but not connected to the free longitudinal edge of the side panel 2013. Of course, either of the rear panel 2014 or the side panel 2013 could include an attachment tab (not shown) that would adhere to the inner surface of the other panel to attach the rear panel 2014 to the side panel 2013.

The resilient mechanism 230 is formed from the resilient mechanism portion 2030 of the blank 2000 as follows. The articulated panel structure is folded such that the first panel of the articulated panel structure 2032 is folded in an opposite direction to the fold between the second panel of the articulated panel structure 2033 and the box rear panel 2014 such that the first and second panels of the articulated panel structure 2032, 2033 sit alongside each other when the lid 220 is in a closed position. The attachment tab 2037 is attached to the inner surface of the lid rear panel 2027, for example by gluing.

With the tabs and panels of the blank 2000 inter-attached in this manner, the structure of the container 200 is formed.

Figure 14:
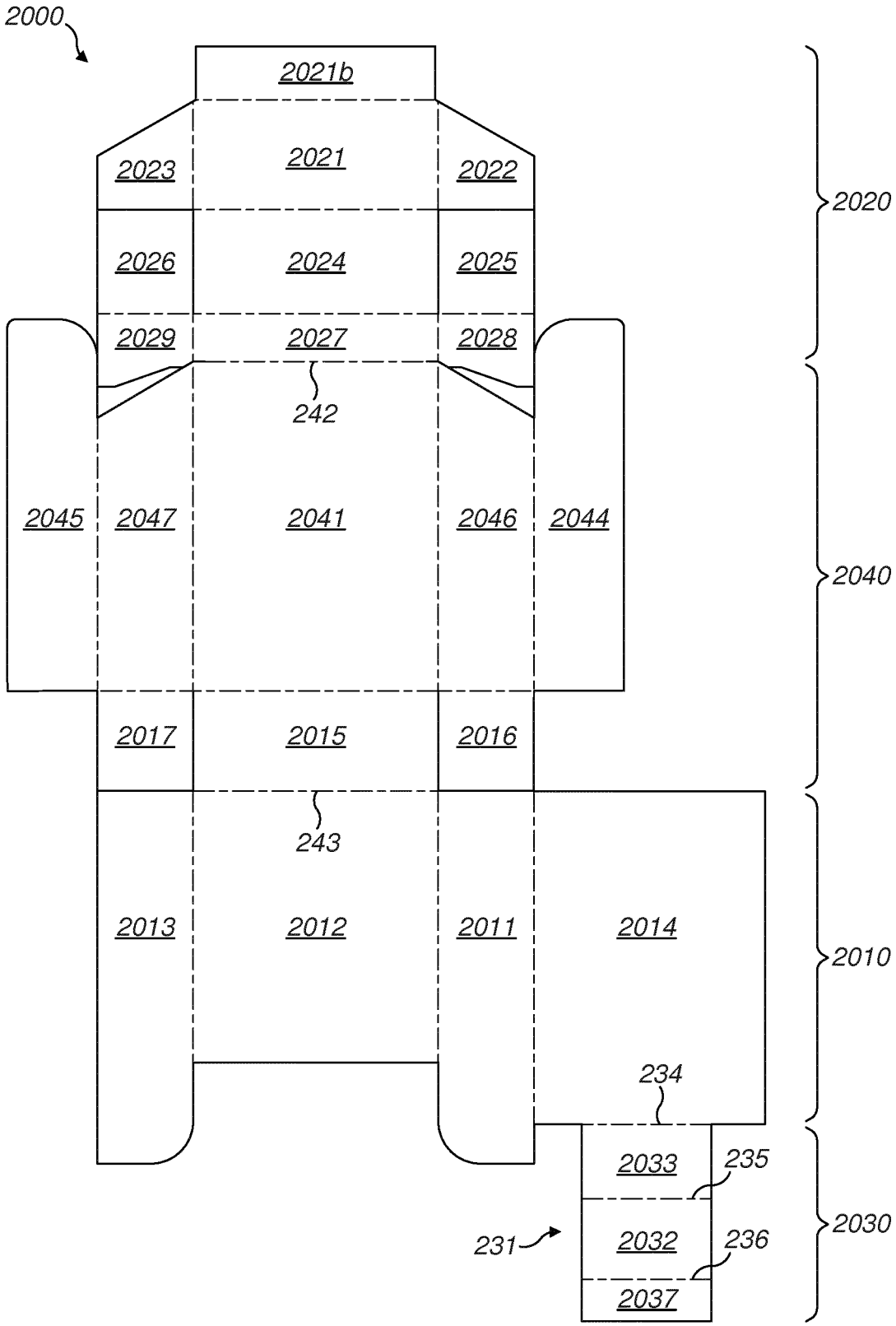

Whilst the blank shown in FIG. 14 forms the container 200 and has been shown with a particular size, shape and configuration of panels and tabs, it will be appreciated that minor changes may be made to these sizes, shapes and/or configuration as is well known in the field of geometric nets. For example, where a tab is used to connect one panel to another panel, generally that tab may be connected via a fold line to either of the two panels on the edge of that panel which is connected to the other panel. Similarly, a panel that is connected via a fold line to another panel in the blank may be changed so that the panel is moved to another location on the blank and a tab is used to connect the two panels together when the blanks are folded.

Optionally, the connector portion 2040 may not include the container bottom panel 2015 and may be hinged to the rear of the base of the container 200, that is, the connector-box hinge line 243 may be moved to the fold line between the container bottom panel 2015 and the connector rear panel 2041. In this example, the box portion may form a complete box, rather than the bottom wall being provided by the connector portion 2040 as illustrated in the example shown in FIGS. 11 to 14.

The invention claimed is:

1. A container for consumer goods, comprising:

a box for receiving goods, the box comprising an open end;

a lid rotatable between open and closed positions for respectively opening and closing the open end of the box;

a hinged connector that connects the lid to the box, where the hinged connector is connected to the lid at a connector-lid hinge line and connected to the box at a connector-box hinge line; and, a resilient mechanism arranged between the box and the connector such that, during lid opening, the resilient mechanism causes relative movement of the box to the connector, wherein the box, the lid, the hinged connector, and the resilient mechanism are integral with each other.

2. The container for consumer goods according to claim 1, wherein the connector-lid hinge line and the connector-box hinge line are substantially parallel to each other.

3. The container for consumer goods according to claim 1, wherein the resilient mechanism is articulately mounted to the hinged connector and the box.

4. The container for consumer goods according to claim 1, wherein the resilient mechanism comprises at least one articulated structure.

5. The container for consumer goods according to claim 4, wherein the at least one articulated structure comprises at least two panels including a first panel rotatably mounted to the hinged connector along a panel-connector rotation axis, and a second panel rotatably mounted to the box along a panel-box rotation axis.

6. The container for consumer goods according to claim 5, wherein the panel-connector rotation axis and the panel-box rotation axis are substantially parallel to each other when the lid is in the closed position.

7. The container for consumer goods according to claim 6, wherein the panel-connector rotation axis is substantially perpendicular to the connector-lid hinge line.

8. The container for consumer goods according to claim 6, wherein movement of the lid from the closed position towards the open position causes the panel-connector rotation axis and the panel-box rotation axis to rotate relative to each other so as to form an angle with each other in the open position.

9. The container for consumer goods according to claim 6, wherein the panel-connector rotation axis and the panel-box rotation axis remain substantially parallel to each other during movement of the lid between the open and closed positions.

10. The container for consumer goods according to claim 9, wherein the panel-connector rotation axis is substantially coincident with the connector-lid hinge line.

11. The container for consumer goods according to claim 5, wherein the first panel is hingedly connected to the second panel along a panel-panel hinge line.

12. The container for consumer goods according to claim 11, wherein the panel-panel hinge line is substantially parallel to the panel-connector rotation axis and to the panel-box rotation axis during movement of the lid between the open and closed positions.

13. The container for consumer goods according to claim 11, wherein the panel-panel hinge line is at a first angle with respect to the panel-connector rotation axis, wherein the panel-panel hinge line is at a second angle with respect to the panel-box rotation axis, and wherein the first and second angles are substantially the same.

14. A container for consumer goods, comprising:

a box for receiving goods, the box comprising an open end;

a lid rotatable between open and closed positions for respectively opening and closing the open end of the box;

a hinged connector connected to the lid at a connector-lid hinge line and connected to the box at a connector-box hinge line; and, at least two panels including a first panel rotatably mounted to the hinged connector along a panel-connector rotation axis, wherein the at least two panels are integrally formed with the box, the lid, and the hinge connector, and and a second panel rotatably mounted to the box along a panel-box rotation axis, wherein the at least two panels are arranged between the box and the connector such that, during lid opening, the at least two panels cause relative movement of the box to the connector.

* * * * *